US009810023B2

(12) United States Patent
Stewart

(10) Patent No.: US 9,810,023 B2
(45) Date of Patent: Nov. 7, 2017

(54) CLIMBING SYSTEM

(71) Applicant: Craig Stewart, Buena Park, CA (US)

(72) Inventor: Craig Stewart, Buena Park, CA (US)

( * ) Notice: Subject to any disclaimer, the term of this patent is extended or adjusted under 35 U.S.C. 154(b) by 0 days.

(21) Appl. No.: 14/992,064

(22) Filed: Jan. 11, 2016

(65) Prior Publication Data

US 2017/0198522 A1 Jul. 13, 2017

(51) Int. Cl.
*E06C 7/42* (2006.01)

(52) U.S. Cl.
CPC ..... *E06C 7/42* (2013.01)

(58) Field of Classification Search
CPC . E06C 7/42; E06C 7/423; E06C 7/426; E06C 7/44; E06C 7/46; E06C 7/06; E06C 7/48; E06C 7/482; E06C 7/484; E06C 7/486; E06C 7/488
See application file for complete search history.

(56) References Cited

U.S. PATENT DOCUMENTS 1,676,618 A * 7/1928 Morris ..... E06C 7/42 182/107
2,868,427 A * 1/1959 Hess ..... E06C 7/42 182/107
3,012,628 A * 12/1961 Zumbaum ..... E06C 7/42 182/111
3,618,703 A * 11/1971 Wilke ..... E06C 7/423 182/107
3,933,221 A * 1/1976 Sorenson ..... E06C 7/42 182/172
4,153,137 A * 5/1979 Johnson ..... E06C 7/42 114/362
4,519,477 A * 5/1985 Ralston ..... E06C 7/423 182/107
4,632,220 A 12/1986 Murrell
5,078,231 A * 1/1992 Davis ..... E06C 7/42 182/107
5,339,921 A * 8/1994 Faupel ..... E06C 7/426 182/111
5,361,868 A * 11/1994 Bartos ..... E06C 7/46 182/111
5,417,302 A * 5/1995 McElfresh ..... E06C 7/46 182/108
D373,428 S 9/1996 Nashleanas et al.
5,791,438 A 8/1998 Kempton
5,896,945 A * 4/1999 Boelling ..... E06C 1/12 182/107
6,328,330 B1 * 12/2001 Haaser ..... B62B 1/20 182/21
7,614,480 B2 * 11/2009 Smiley ..... E06C 1/22 182/127
7,743,886 B2 6/2010 Feemster, Jr. et al.
8,464,834 B2 * 6/2013 Blazin ..... E06C 7/06 182/107

(Continued)

FOREIGN PATENT DOCUMENTS

WO WO2008151435 12/2008

*Primary Examiner* — Katherine Mitchell
*Assistant Examiner* — Shiref Mekhaeil

(57) ABSTRACT

A climbing system for inhibiting a ladder from tipping includes a ladder that may be climbed. A platform is provided and the platform may be positioned on a support surface. The ladder is removably coupled to the platform such that the platform inhibits the ladder from tipping.

5 Claims, 5 Drawing Sheets

(56) References Cited

U.S. PATENT DOCUMENTS

| | | | | |
|---|---|---|---|---|
| 9,016,433 | B1 * | 4/2015 | Duffy | E04G 3/26 182/45 |
| 9,133,594 | B2 * | 9/2015 | Hurley | E02D 5/80 |
| 9,556,675 | B2 * | 1/2017 | Reyes | E06C 9/08 |
| 2001/0015303 | A1 * | 8/2001 | Laug | E06C 7/48 182/107 |
| 2002/0166723 | A1 * | 11/2002 | Huber | E06C 5/24 182/127 |
| 2005/0011702 | A1 * | 1/2005 | Zeaman | E06C 7/42 182/108 |
| 2006/0054391 | A1 * | 3/2006 | Tilley | E04D 15/00 182/107 |
| 2007/0284190 | A1 * | 12/2007 | Chady | E06C 7/46 182/107 |
| 2008/0314682 | A1 * | 12/2008 | Cogswell | E06C 7/423 182/108 |
| 2011/0132684 | A1 * | 6/2011 | Wilkins | E06C 7/46 182/107 |
| 2012/0199416 | A1 * | 8/2012 | Hopkins | E06C 7/46 182/111 |
| 2013/0119213 | A1 * | 5/2013 | Watson | E06C 7/42 248/201 |
| 2014/0318894 | A1 * | 10/2014 | Chow | E06C 7/48 182/214 |
| 2016/0281427 | A1 * | 9/2016 | Weatherall | E06C 7/48 |
| 2016/0348435 | A1 * | 12/2016 | Weston | E06C 7/486 |
| 2016/0348436 | A1 * | 12/2016 | Reyes | E06C 9/08 |
| 2016/0369563 | A1 * | 12/2016 | Adcock | E06C 7/48 |

* cited by examiner

CLIMBING SYSTEM

BACKGROUND OF THE DISCLOSURE

Field of the Disclosure

The disclosure relates to climbing devices and more particularly pertains to a new climbing device for inhibiting a ladder from tipping.

SUMMARY OF THE DISCLOSURE

An embodiment of the disclosure meets the needs presented above by generally comprising a ladder that may be climbed. A platform is provided and the platform may be positioned on a support surface. The ladder is removably coupled to the platform such that the platform inhibits the ladder from tipping.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
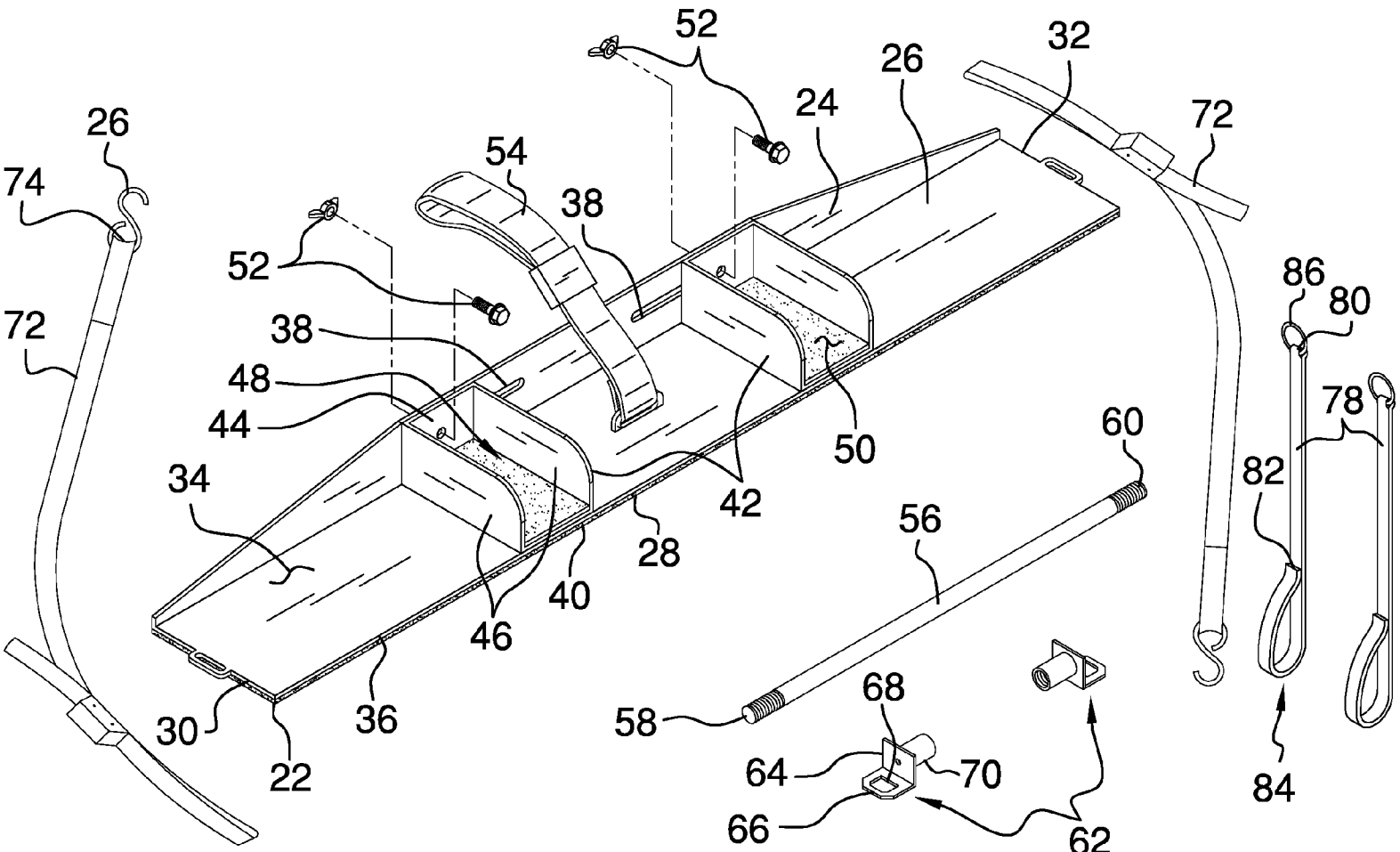
FIG. 1 is a perspective view of a climbing system according to an embodiment of the disclosure.
Figure 2:
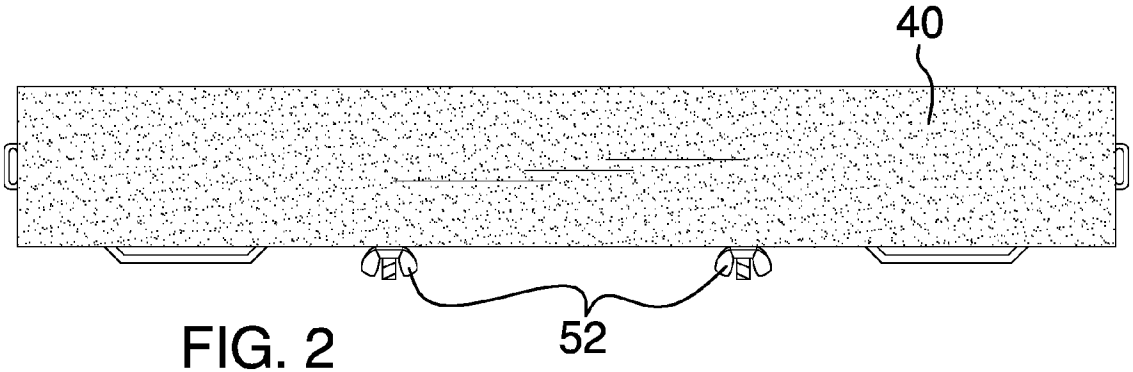
FIG. 2 is a bottom view of an embodiment of the disclosure.
Figure 3:
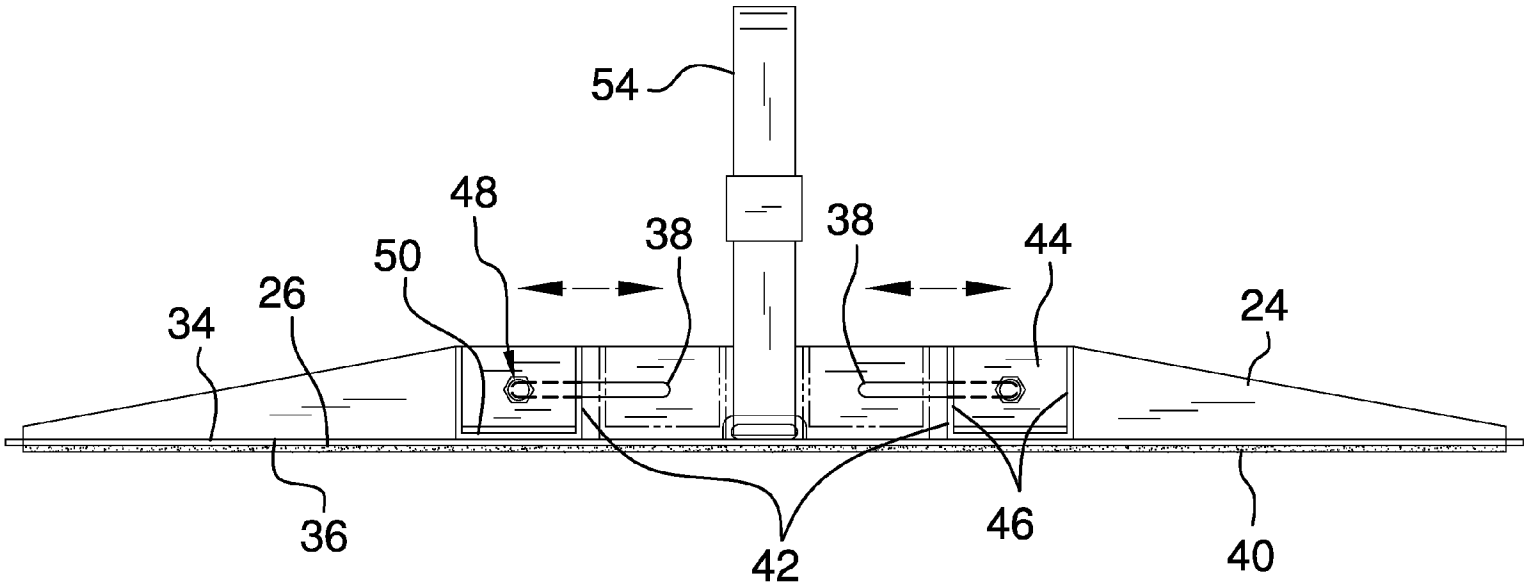
FIG. 3 is a front view of an embodiment of the disclosure.
Figure 4:
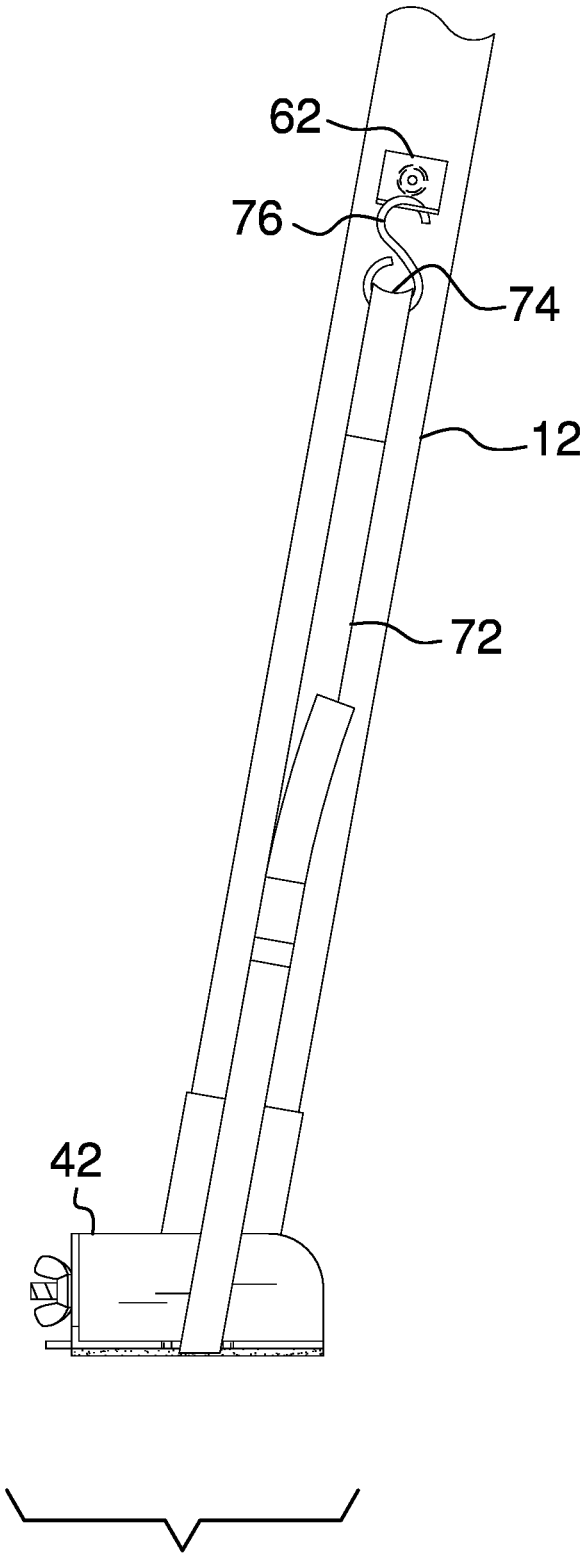
FIG. 4 is a right side view of an embodiment of the disclosure.
Figure 5:
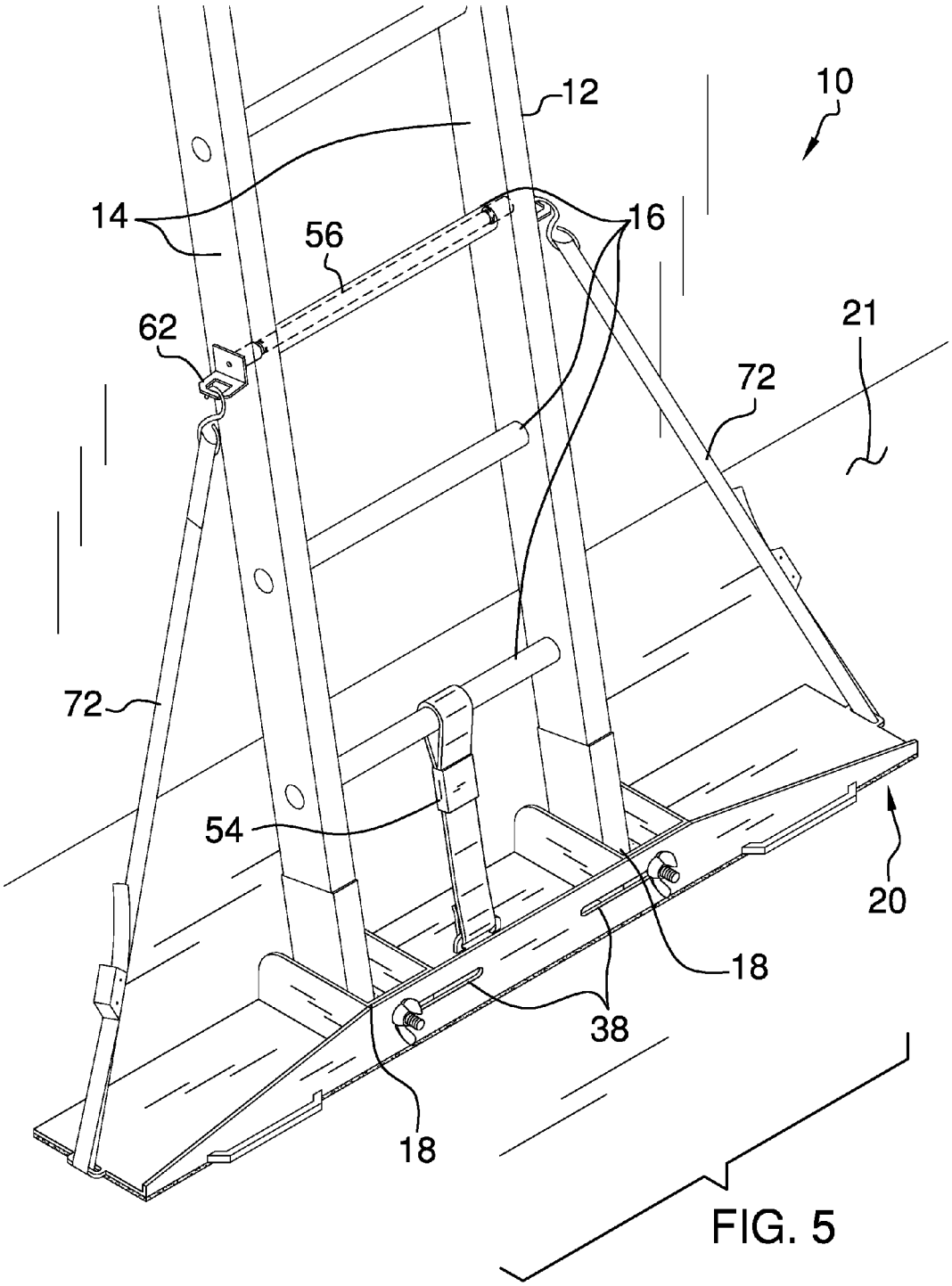
FIG. 5 is a perspective in-use view of an embodiment of the disclosure.
Figure 6:
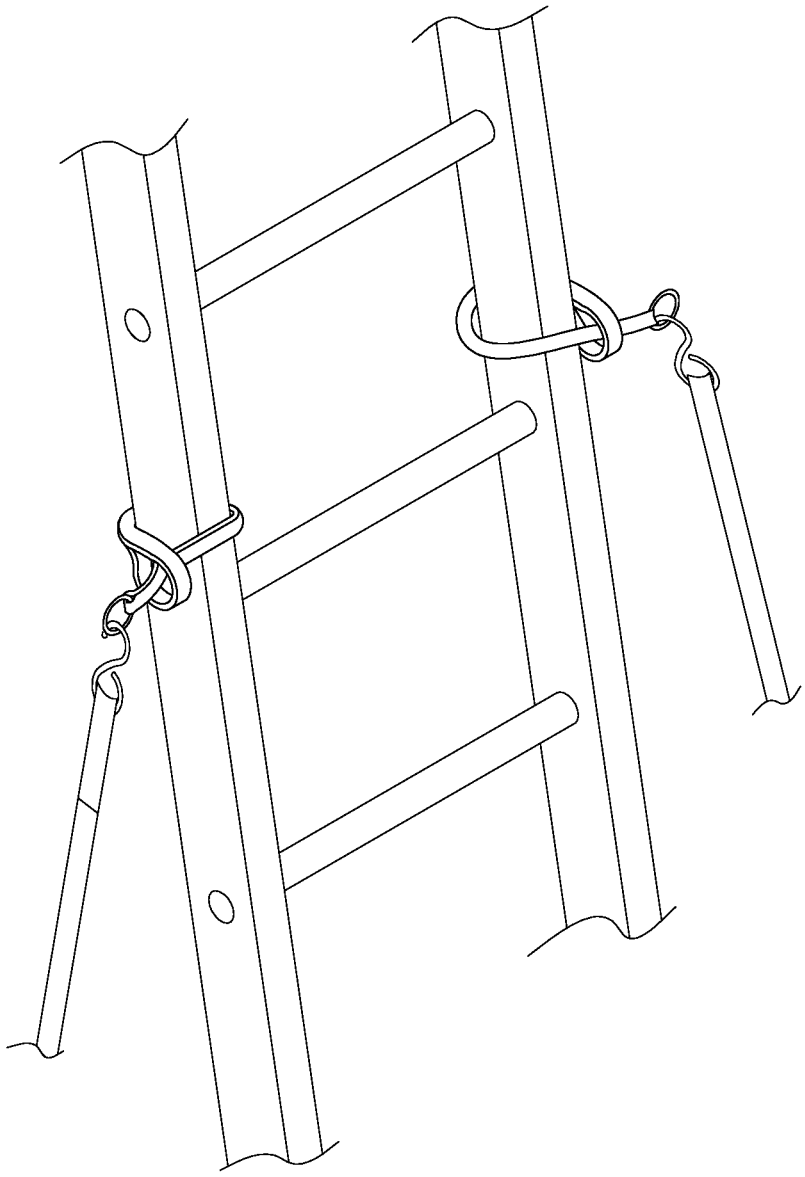
FIG. 6 is a perspective in-use view showing a pair of belts of an embodiment of the disclosure.

With reference now to the drawings, and in particular to FIGS. 1 through 6 thereof, a new climbing device embodying the principles and concepts of an embodiment of the disclosure and generally designated by the reference numeral 10 will be described.

As best illustrated in FIGS. 1 through 6, the climbing system 10 generally comprises a ladder 12 that may be climbed. The ladder 12 has a pair of legs 14 and a plurality of rungs 16 extending through each of the legs 14. Each of the legs 14 has a bottom end 18. Each of the rungs 16 is substantially hollow. The ladder 12 may comprise an extension ladder or the like.

A platform 20 is provided. The platform 20 may be positioned on a support surface 21. The support surface 21 may be ground. The ladder 12 is removably coupled to the platform 20 such that the platform 20 inhibits the ladder 12 from tipping.

The platform 20 comprises a panel 22 that has a first portion 24 forming an angle with a second portion 26. The second portion 26 has a first edge 28 and the first edge 28 is spaced from the first portion 24. The panel 22 has a first end 30, a second end 32, a top surface 34 and a bottom surface 36. The panel 22 is elongated between the first end 30 and the second end 32.

The first portion 24 has a pair of slots 38 extending therethrough. Each of the slots 38 is horizontally oriented on the first portion 24. The slots 38 are aligned with each other and the slots 38 are spaced apart from each other. The bottom surface 36 corresponding to the second portion 26 may be positioned on the support surface 21. A pad 40 is coupled to the bottom surface 36 and the pad 40 substantially covers the bottom surface 36. The pad 40 frictionally engages the support surface 21 thereby inhibiting the panel 22 from sliding on the support surface 21.

A pair of saddles 42 is provided. Each of the saddles 42 is slidably positioned on the top surface 34 corresponding to the second portion 26. Each of the saddles 42 has a front wall 44 and a pair of lateral walls 46. The lateral walls 46 corresponding to each of the saddles 42 is spaced apart from each other to define a space 48 in the corresponding saddle 42.

Each of the saddles 42 extends between the first portion 24 and the first edge 28. The saddles 42 are spaced apart from each other and distributed between the first end 30 and the second end 32. The bottom end 18 of each of legs 14 is positioned in the space 48 of an associated one of the saddles 42 such that the ladder 12 extends upwardly from the panel 22. The space 48 in each of the saddles 42 has a lower bounding surface 50. The lower bounding surface 50 is textured thereby enhancing frictional engagement between the ladder 12 and the saddles 42.

A pair of fasteners 52 is provided. Each of the fasteners 52 extends through an associated one of the slots 38 and engages the front wall 44 of an associated one of the saddles 42. Each of the fasteners 52 retains the associated saddle 42 at a selected point along the associated slot 38. Each of the fasteners 52 may comprise a nut and a bolt or the like.

A first strap 54 is coupled to the top surface 34 corresponding to the second portion 26. The first strap 54 is positioned between the saddles 42. The first strap 54 engages one of the rungs 16 when the ladder 12 is positioned in the saddles 42. Thus, the ladder 12 is removably retained on the platform 20.

A rod 56 is provided. The rod 56 has a primary end 58 and a secondary end 60. The rod 56 is threaded adjacent to each of the primary end 58 and the secondary end 60. The rod 56 is slidable into a selected one of the rungs 16.

A pair of retainers 62 is provided. Each of the retainers 62 has a leg 64 and a foot 66. The foot 66 has a hole 68 extending therethrough such that the foot 66 forms a closed loop. The leg 64 has a sleeve 70 extending away from the foot 66. The sleeve 70 of each of the retainers 62 threadably engages an associated one of the primary end 58 and the secondary end 60 when the rod 56 is extended through the selected rung 16.

A pair of second straps 72 is provided. Each of the second straps 72 is coupled to an associated one of the first end 30 and the second end 32 of the panel 22. Each of the second straps 72 has a distal end 74 with respect to the panel 22. A hook 76 is coupled to the distal end 74 of each of the second straps 72. The hook 76 engages the foot 66 of an associated one of the retainers 62 such that the ladder 12 is removably coupled to the panel 22.

A pair of belts 78 is provided. Each of the belts 78 has a first end 80 and a second end 82. The second end 82 is fastened to the associated belt 78 to define a loop 84 on each of the belts 78. Each of the belts 78 has a ring 86 coupled to the first end 80. Each of the belts 78 is wrapped around an associated one of the legs 14 on the ladder 12.

The ring 86 on each of the belts 78 is extended through the associated loop 84. Thus, each of the belts 78 is removably fastened to the ladder 12. The hook 76 on an associated one of the second straps 72 is coupled to the ring 86 on an associated one of the belts 78. The belts 78 secure the second straps 72 to the ladder 12 when the rod 56 cannot be inserted through the selected rung 16.

In use, the platform 20 is positioned on the support surface 21. The saddles 42 are manipulated and aligned with the legs 14 of the ladder 12. The fasteners 52 are manipulated to retain the saddles 42 at the selected point and the ladder 12 is positioned in the saddles 42. The first strap 54 is coupled to the ladder 12. The rod 56 is extended through the selected rung 16 and each of the retainers 62 are coupled to the rod 56. Each of the second straps 72 is coupled to the associated retainer 62. The ladder 12 is climbed and the platform 20 inhibits the ladder 12 from tipping laterally.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A climbing system comprising:

a ladder being configured to be climbed, said ladder having a pair of legs and a plurality of rungs extending through each of said legs, each of said legs having a bottom end, each of said rungs being substantially hollow;

a platform being configured to be positioned on a support surface, said ladder being removably coupled to said platform such that said platform inhibits said ladder from tipping, wherein said platform comprises a panel having a first portion forming an angle with a second portion, said second portion having a first edge, said first edge being spaced from said first portion, said panel having a first end, a second end, a top surface and a bottom surface, said panel being elongated between said first end and said second end;

a rod having a primary end and a secondary end, said rod being threaded adjacent to each of said primary end and said secondary end, said rod being slidable into a selected one of said rungs;

a pair of retainers, each of said retainers having a leg and a foot, said foot having a hole extending therethrough such that said foot forms a closed loop, said leg having a sleeve extending away from said foot, said sleeve of each of said retainers threadably engaging an associated one of said primary end and said secondary end when said rod is extended through said selected rung;

a pair of saddles, each of said saddles being slidably positioned on said top surface corresponding to said second portion, each of said saddles having a front wall and a pair of lateral walls, said lateral walls corresponding to each of said saddles being spaced apart from each other to define a space in said corresponding saddle;

a first strap being coupled to said top surface corresponding to said second portion, said first strap being positioned between said saddles, said first strap engaging one of said rungs when said ladder is positioned in said saddles such that said ladder is removably retained on said platform;

a pair of second straps, each of said second straps being coupled to an associated one of said first end and said second end, each of said second straps having a distal end with respect to said panel, said distal end of each of said straps having a hook being coupled to said distal end, said hook engaging said closed loop of said foot of an associated one of said retainers such that said ladder is removably coupled to said panel.

2. The system according to claim 1, wherein said first portion has a pair of slots extending therethrough, each of said slots being horizontally oriented on said first portion, said slots being aligned with each other, said slots being spaced apart from each other, said bottom surface corresponding to said second portion being configured to be positioned on the support surface.

3. The system according to claim 1, wherein:

said ladder has a pair of legs, each of said legs having an end; and each of said saddles extends between said first portion and said first edge, said saddles being spaced apart from each other and distributed between said first end and said second end, said bottom end of each of legs being positioned in said space of an associated one of said saddles such that said ladder extends upwardly from said panel.

4. The system according to claim 1, further comprising:

said first portion having a pair of slots; and a pair of fasteners, each of said fasteners extending through an associated one of said slots and engaging said front wall of an associated one of said saddles, each of said fasteners retaining said associated saddle at a selected point along said associated slot.

5. A climbing system comprising:

a ladder being configured to be climbed, said ladder having a pair of legs and a plurality of rungs extending through each of said legs, each of said legs having a bottom end, each of said rungs being substantially hollow; and a platform being configured to be positioned on a support surface, said ladder being removably coupled to said platform such that said platform inhibits said ladder from tipping, said platform comprising:

a panel having a first portion forming an angle with a second portion, said second portion having a first edge, said first edge being spaced from said first portion, said panel having a first end, a second end, a top surface and a bottom surface, said panel being elongated between said first end and said second end, said first portion having a pair of slots extending therethrough, each of said slots being horizontally oriented on said first portion, said slots being aligned with each other, said slots being spaced apart from each other, said bottom surface corresponding to said second portion being configured to be positioned on the support surface, a pair of saddles, each of said saddles being slidably positioned on said top surface corresponding to said second portion, each of said saddles having a front wall and a pair of lateral walls, said lateral walls corresponding to each of said saddles being spaced apart from each other to define a space in said corresponding saddle, each of said saddles extending between said first portion and said first edge, said saddles being spaced apart from each other and distributed between said first end and said second end, said bottom end of each of legs being positioned in said space of an associated one of said saddles such that said ladder extends upwardly from said panel, a pair of fasteners, each of said fasteners extending through an associated one of said slots and engaging said front wall of an associated one of said saddles, each of said fasteners retaining said associated saddle at a selected point along said associated slot, a first strap being coupled to said top surface corresponding to said second portion, said first strap being positioned between said saddles, said first strap engaging one of said rungs when said ladder is positioned in said saddles such that said ladder is removably retained on said platform, a rod having a primary end and a secondary end, said rod being threaded adjacent to each of said primary end and said secondary end, said rod being slidable into a selected one of said rungs, a pair of retainers, each of said retainers having a leg and a foot, said foot having a hole extending therethrough such that said foot forms a closed loop, said leg having a sleeve extending away from said foot, said sleeve of each of said retainers threadably engaging an associated one of said primary end and said secondary end when said rod is extended through said selected rung, and a pair of second straps, each of said second straps being coupled to an associated one of said first end and said second end, each of said second straps having a distal end with respect to said panel, said distal end of each of said straps having a hook being coupled to said distal end, said hook engaging said foot of an associated one of said retainers such that said ladder is removably coupled to said panel.

* * * * *